US010267007B2

(12) United States Patent
Hayman

(10) Patent No.: US 10,267,007 B2
(45) Date of Patent: Apr. 23, 2019

(54) POST SUPPORT DEVICE

(71) Applicant: SubBase Building Technologies Limited, Kaeo (NZ)

(72) Inventor: Paul David Hayman, Kaeo (NZ)

(73) Assignee: SubBase Building Technologies Limited, Kaeo (NZ)

( * ) Notice: Subject to any disclaimer, the term of this patent is extended or adjusted under 35 U.S.C. 154(b) by 0 days.

(21) Appl. No.: 15/113,041

(22) PCT Filed: Jan. 22, 2015

(86) PCT No.: PCT/NZ2015/000001
§ 371 (c)(1),
(2) Date: Jul. 20, 2016

(87) PCT Pub. No.: WO2015/112026
PCT Pub. Date: Jul. 30, 2015

(65) Prior Publication Data

US 2017/0022679 A1 Jan. 26, 2017

(30) Foreign Application Priority Data

Jan. 23, 2014 (NZ) ..... 620317

(51) Int. Cl.
*E02D 27/42* (2006.01)

(52) U.S. Cl.
CPC ..... *E02D 27/42* (2013.01); *E02D 2250/0023* (2013.01); *E02D 2300/002* (2013.01); *E02D 2600/30* (2013.01)

(58) Field of Classification Search
CPC ..... E02D 27/42; E04H 12/2269; E04B 1/41
See application file for complete search history.

(56) References Cited

U.S. PATENT DOCUMENTS

| | | | | | |
|---|---|---|---|---|---|
| 90,611 | A * | 5/1869 | Unger | E04H 12/2269 | 52/298 |
| 100,666 | A * | 3/1870 | Prentiss | E04H 12/2269 | 52/298 |
| 900,517 | A * | 10/1908 | Glover | E04H 12/2269 | 52/298 |
| 5,800,727 | A * | 9/1998 | Croghan | E04G 13/021 | 249/13 |
| 5,819,487 | A * | 10/1998 | Bull | E02D 27/42 | 52/295 |
| 5,901,525 | A * | 5/1999 | Doeringer | E02D 27/42 | 248/519 |
| 6,256,961 | B1 * | 7/2001 | Byrnes | E01F 15/0469 | 248/345.1 |
| 8,408,845 | B2 * | 4/2013 | Hutchinson | E02D 5/00 | 248/357 |
| 2004/0111991 | A1 * | 6/2004 | Swinimer | E02D 27/42 | 52/294 |
| 2007/0187564 | A1 * | 8/2007 | McGuire | E02D 27/42 | 248/346.5 |

(Continued)

*Primary Examiner* — Tara Mayo-Pinnock

(57) ABSTRACT

A support device adapted to support the base of a post or pile above the base of a foot hole excavated in preparation for pouring concrete having a lower tier adapted to contact the base of the foot hole and provide a support surface and an upper tier adapted to provide a post or pile supporting platform. The lower tier and the upper tier are separated by one or more support walls that define a region beneath the base of the post or pile to be filled with concrete.

21 Claims, 11 Drawing Sheets

(56) References Cited

U.S. PATENT DOCUMENTS

2012/0085050 A1* 4/2012 Greenwood ..... E04B 1/41
52/296
2013/0312340 A1* 11/2013 Miller ..... E04H 12/22
52/169.13

* cited by examiner

Bottom plan view

Top plan view

Side elevation

POST SUPPORT DEVICE

FIELD OF THE INVENTION

The invention generally relates to a support device and in particular a support device for assisting with the setting of posts and piles in concrete filled footing holes.

BACKGROUND

Building codes in some countries, for example New Zealand, require piles and posts to have 100 mm of concrete under them when they are set in concrete. This requires each post or pile to be vertically suspended 100 mm above the bottom of a footing hole while the concrete is poured in and until the concrete is set.

Footing holes for the piles or posts are measured and marked on the ground prior to the footing holes being excavated by digging or by post hole borer. String lines are used to set out the line if a builder has a line of piles/posts to set in concrete footings.

Contemporary practice is to suspend a post or pile above a footing hole is for one builder to hold the post or pile 100 mm above the bottom of the footing hole and in a desired location while another builder fixes the post in place by constructing a stabilising framework of lines of timber and braces.

FIG. 1 illustrates a line of posts 1, each residing in a footing hole 2 that has been excavated to receive a concrete pour. A framework is shown to support each post and includes a plurality of lateral support braces 3 and transverse support braces 5 arranged at ninety degrees to each other to support the upper end of each post. A timber piece 3 is arranged to span across and attach to the lower of each post for further support. The timber piece 3 can be anchored to the ground by a plurality of pegs 7. The lateral braces 4 attach to the lower end of each timber piece 3 for stability. A plurality of pegs 6 attach to the lower end of each transverse brace 5 to the ground for stability.

The framework is fastened together by a first builder suspending each post and stabilising each post in position while another builder fastens the framework together with nails or screws. Heavy or tall posts often require further stabilising framework to prevent toppling.

The footing hole is filled with concrete when enough framework is constructed to stabilise the post. The second builder may then be relieved from their job of holding the post or pile in position. The framework is removed when the concrete hardens.

Other contemporary practices to suspend posts or piles above footing holes would include one builder holding the post or pile 100 mm above the bottom of the footing hole and in a desired location while another builder pours the concrete into the footing hole.

Then a builder will have check that the post or pile is in the correct location, while trying to keep the post or pile suspended 100 mm above the bottom of the footing hole while the concrete hardens sufficiently to relieve the builder.

The process of suspending each post or pile and building a framework to hold each post or pile in place before concreting is onerous. It is therefore an object of the invention to facilitate an improved process which overcomes or at least ameliorates the abovementioned disadvantages or which at least provides the public with a useful choice.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

SUMMARY OF THE INVENTION

In one aspect the invention broadly consists in a device adapted to support the base of a post or pile comprising a lower tier and an upper tier separated by one or more support walls, the lower tier adapted to provide a ground contacting platform, the upper tier adapted to provide a post or pile contacting platform, the one or more support walls span at least between the lower tier and the upper tier.

In another aspect the invention broadly consists in a kit of parts able to be assembled to form a support device, the kit comprising a lower tier, an upper tier and one or more support walls, the lower tier adapted to provide a ground contacting platform, the upper tier adapted to provide a post or pile contacting platform, the one or more support walls adapted to attach to and span at least between the lower tier and the upper tier.

In another aspect the invention broadly consists in a method of using a device adapted to support the base of a post or pile, wherein the device comprises a lower tier and an upper tier separated by one or more support walls, the lower tier adapted to provide a ground contacting platform, the upper tier adapted to provide a post or pile contacting platform, the one or more support walls spanning at least between the lower tier and the upper tier, the one or more support walls extending beyond the upper tier to define an enclosure region, and wherein the method comprises one or more of the following steps, in any order:

- setting out a string line for a line of posts or piles, measure the particular locations for the pile or post along the line, and excavate the footing holes,
- attaching a support base to the bottom of a pile by inserting the pile into the enclosure region and connecting the pile and support base with a fastener,
- excavating a footing hole,
- placing the post or pile, with attached support device, into a footing hole,
- moving or sliding the post support device around in the footing hole to locate the post or pile in a desired position,
- attaching one or more bracing members to the top of each post or pile, and/or
- pouring concrete into the footing hole.

In another aspect the invention broadly consists in a method of using a device adapted to support the base of a post or pile for concreting and preparing a house and/or deck subfloor, wherein the device comprises a lower tier and an upper tier separated by one or more support walls, the lower tier adapted to provide a ground contacting platform, the upper tier adapted to provide a post or pile contacting platform, the one or more support walls spanning at least between the lower tier and the upper tier, the one or more support walls extending beyond the upper tier to define an enclosure region, and wherein the method comprises one or more of the following steps, in any order:

- providing materials to build a house and/or deck subfloor, including piles, bearers and floor/deck joists,
- providing support bases for each pile,
- constructing corner profiles with level profile boards about a meter outside each corner of the house, marking out a building perimeter with a string line, setting out intermediate string lines to mark a line of piles, marking out individual piles along each string line, excavating the footing holes, attaching a support base to the bottom of a pile by inserting the pile into the enclosure region and connecting the pile and support base with a fastener, placing the piles with the support base attached into the footing holes, and/or concreting the piles into place.

Preferably the one or more support walls extend beyond the upper tier to define an enclosure region between the inner surface of the support walls and the upper surface of the upper tier.

Preferably the enclosure region is adapted to substantially enclose the bottom of a post or pile residing on the upper tier.

Preferably the enclosure region is formed between the inner surface of the support walls and the upper surface of the upper tier.

Preferably a portion of the one or more support walls extending beyond the upper tier has one or more holes configured to allow a fastener to pass.

Preferably the upper tier has a profile adapted to closely match the profile of a post or pile to be supported.

Preferably the upper tier has a square profile.

Preferably the lower tier has a round profile.

Preferably the lower tier has a ground contacting side that is corrugated.

Preferably the lower tier has a raised outer peripheral edge.

Preferably the lower tier has an aperture with a raised peripheral edge.

Preferably the lower tier has an outside span of approximately 235 mm.

Preferably the upper and lower tier are separated by a distance of approximately 100 mm.

Preferably the device further comprises an insert with an outer surface adapted to fit the enclosure region and an inner surface adapted to fit a post or pile to be supported.

Preferably the one or more side walls have one or more apertures.

Preferably the upper and/or lower tier has one or more apertures.

Preferably the one or more support walls overlap to form, at least in part, a lattice structure.

Preferably the one or more support walls comprise an arrangement of flat walls.

Preferably the one or more support walls comprise a substantially continuous conical wall.

Preferably the lower tier has a ground contacting side that is corrugated in section.

Preferably the lower tier has a raised outer peripheral edge.

Preferably the lower tier has an aperture with a raised inner peripheral edge.

Preferably the lower tier has an outside span of approximately 235 mm.

Preferably the upper tier and lower tier are separated by a distance of approximately 100 mm.

Preferably the device further comprises an insert with an outer surface adapted to fit the enclosure region and an inner surface adapted to fit a post or pile to be supported.

Preferably the hole is a concrete filled footing hole.

The following embodiments may relate to any of the above aspects. Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "comprising" as used in this specification means "consisting at least in part of". When interpreting statements in this specification which include that term, the features, prefaced by that term in each statement or claim, all need to be present but other features can also be present. Related terms such as "comprise" and "comprised" are to be interpreted in the same manner.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

The invention will now be described by way of example only and with reference to the drawings in which.

DETAILED DESCRIPTION

The invention is a support base that improves the process setting posts or piles in concrete filled footing holes. The support base enables posts or piles to be set in place by one builder and without the requirement for support from a second builder. Further, the invention facilitates a minimum required depth of concrete beneath the post or pile which is otherwise difficult when placing heavy posts or piles into a footing hole that has been excavated, for example, for concrete pouring.

Figure 1:
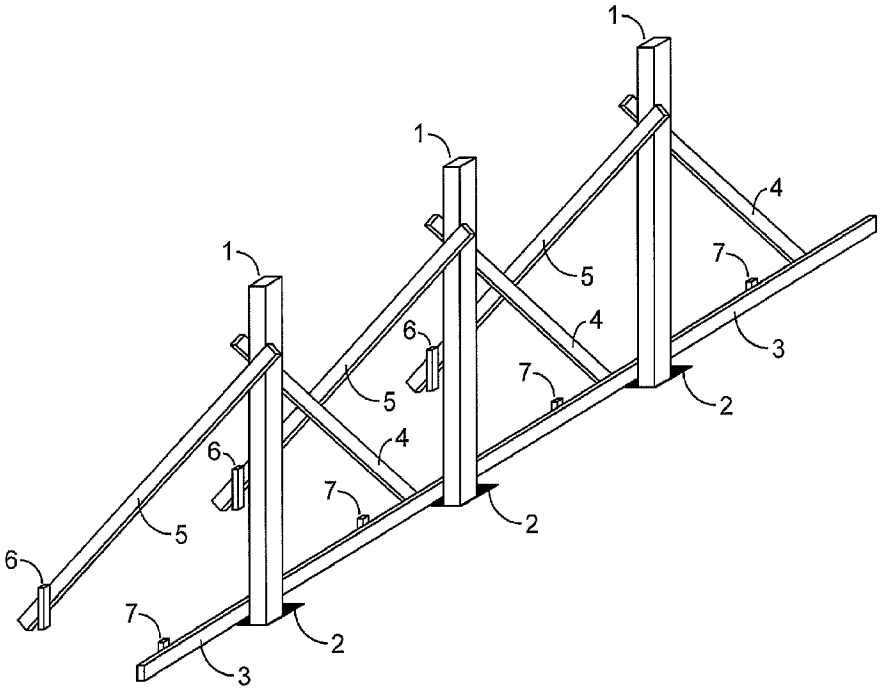
FIGURE 1 Prior Art
FIG. 1 shows a line of posts/piles stabilised by support braces, and suspended by being fixed to timber spanning the holes and the posts/piles each residing in a footing hole that has been dug to receive concrete.
Figure 2:
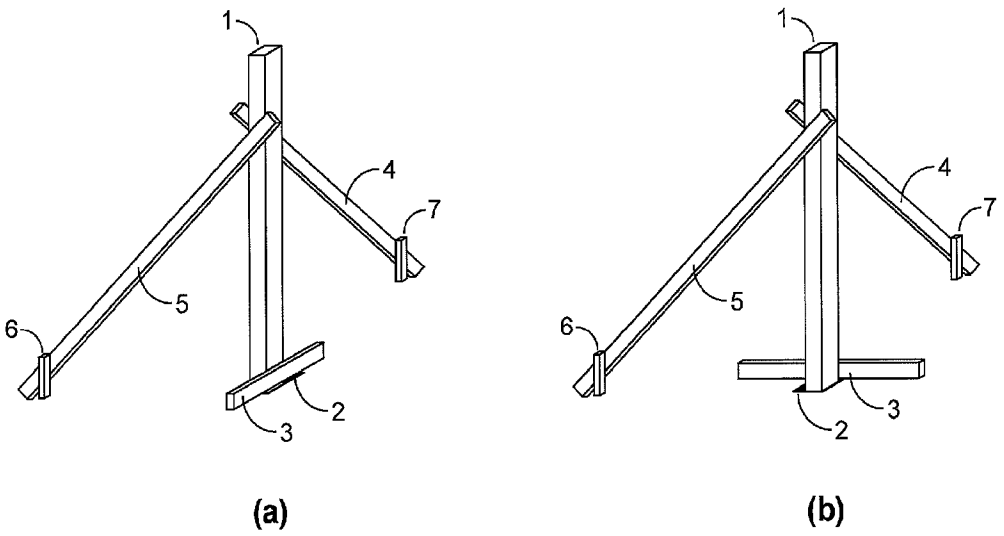
FIGURE 2 Prior Art
FIG. 2 shows two examples of a single post/pile stabilised by support braces, and suspended by being fixed to timber piece spanning the hole the post/pile residing in a footing hole that has been dug to receive concrete.
Figure 3:
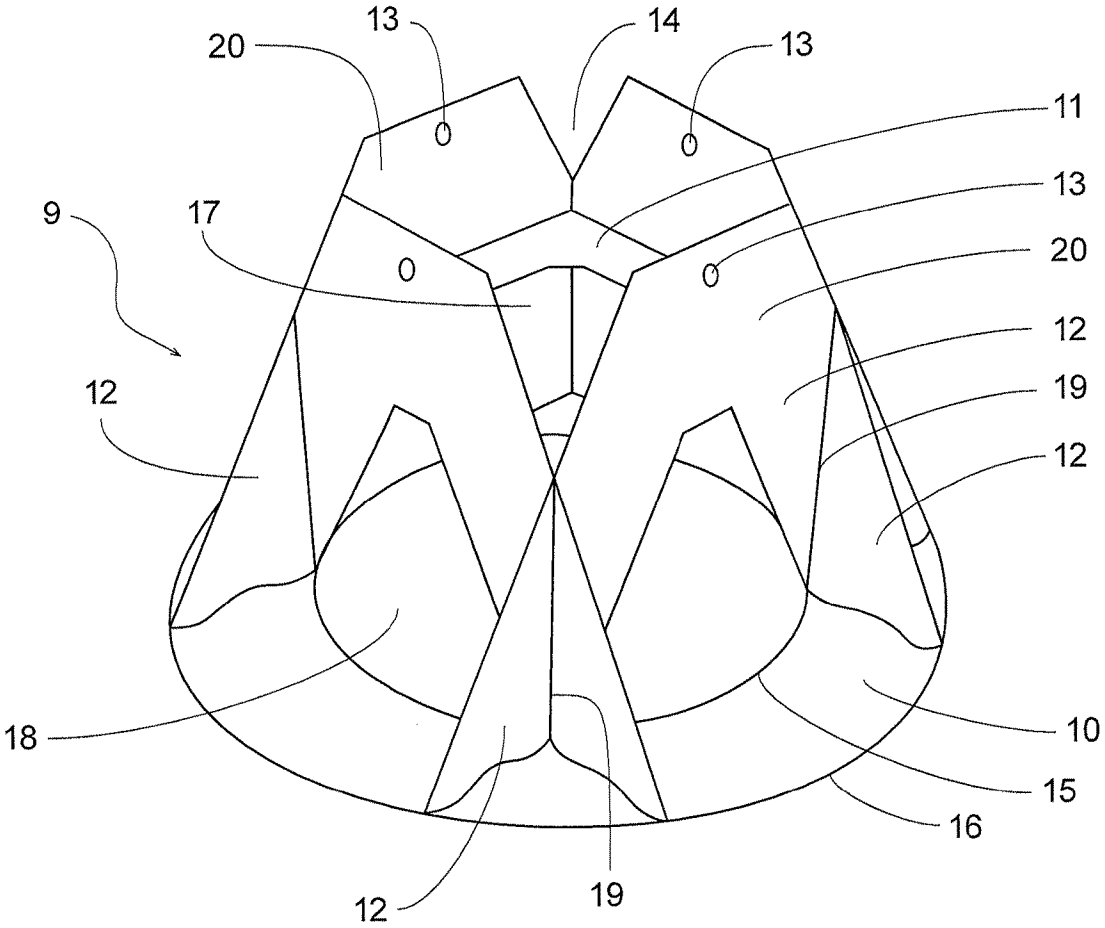
FIG. 3 shows a support base according to an embodiment of the invention with a square profile upper tier.
Figure 4:
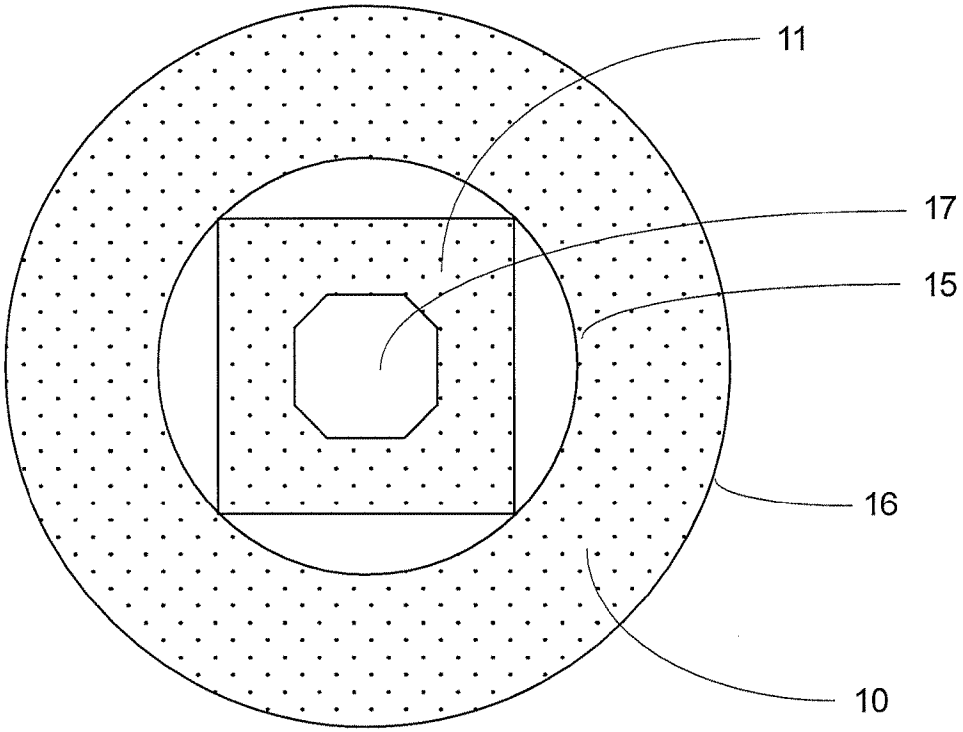
FIG. 4 shows a plan view of the bottom of the support base of the embodiment of FIG. 3.
Figure 5:
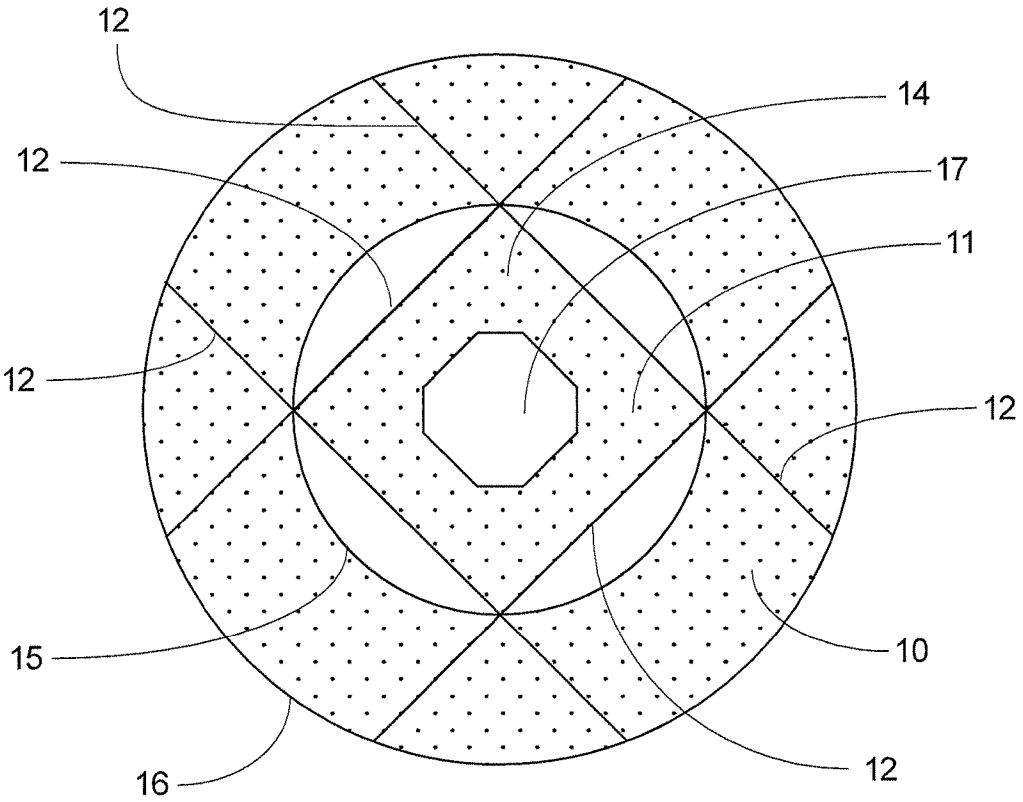
FIG. 5 shows a plan view of the top of the support base with a square profile upper tier of the embodiment of FIG. 3.
Figure 6:
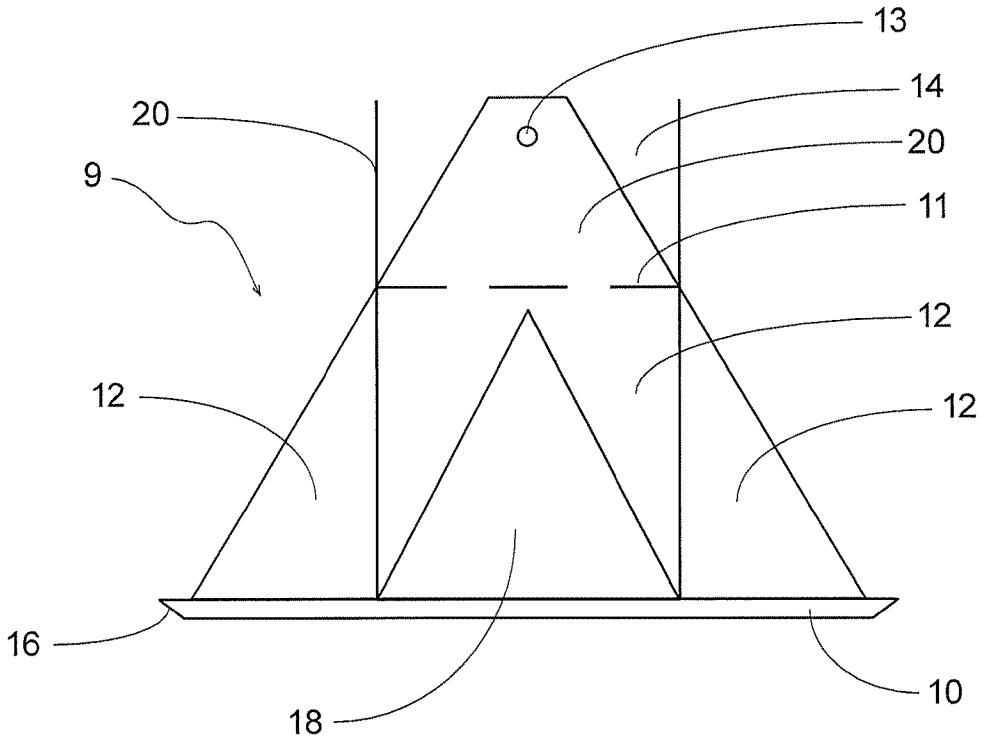
FIG. 6 shows a side profile of the embodiment of FIG. 3.

FIGS. 3 to 6 show a support base 9 according to various embodiments of the invention. In particular FIG. 3 shows a perspective view of one embodiment and FIG. 6 shows a side view of the embodiment of FIG. 3. The support base is configured to attach to the bottom of a post or pile to provide a support platform. When attached to the bottom of a post or pile, the support base maintains a post or pile a height above the base of a foot hole. Further, in some circumstances, the support base enables the post or pile to free stand. In other circumstances a post or pile attached to a support base is further supported by one or more braces that one person can assemble without the requirement for a second person.

The support base 9 has a lower tier 10 and an upper tier 11 and a one or more support walls 12. For example, in the embodiment shown there are four support walls. However, in other embodiments, two, three or more support walls are used to stabilise the upper tier above the lower tier. The upper tier 11 is adapted to provide a platform upon which a post or pile can sit. The lower tier is adapted to provide a ground resting platform. The support wall or walls 12 are adapted to span at least between the lower tier and the upper tier to maintain a separation distance between the tiers. The separation distance accords to a predetermined desired height which a post or pile is desired to be suspended above the base of a foot hole. For example, the predetermined height is 100 mm when abidance with New Zealand building standards is desired.

In some embodiments there is a single support wall extending between the upper and lower tiers. In other embodiments the support walls are arranged as substantially flat surfaces that extend upward from upper surface of the lower tier to the periphery of the upper tier. In some embodiments the support walls overlap, such as shown in FIG. 3, such that a lattice structure 19 is formed. A lattice type structure formed by the support walls improves the load carrying ability and stability of the upper tier by providing compressive strength and resistance to lateral movement.

In some embodiments the support walls 12 extend above and surround the upper tier 11 to form an enclosure region 14 open to at least the upper side. The support wall or walls and upper tier are arranged such that a post or pile is receivable within the defined enclosure region.

In some embodiments the post or pile is received within the enclosure region with an interference fit. In other embodiments the enclosure region 14 comprises flaps 20 that are arranged to surround the upper tier and be fixed to a post or pile sitting on the upper tier. In other embodiments the upper portion of the support walls or flaps 20 comprise one or more holes 13 adapted to allow a fastener to pass through the support wall or flap to thereby fix a post to the support base. The holes 13 are located in one or more of the support walls or flaps 20 above the position of the upper tier 11.

In some embodiments the enclosure region 14 is square in profile such as shown in FIG. 4 and FIG. 5. In other embodiments the enclosure region is circular.

In some embodiments the enclosure region 14 is formed from a secondary support wall 15 that resides within the support walls 12. In some embodiments the secondary support wall 15 is removable such that the support base 9 is suitable for a smaller post. The secondary support wall has an outer surface adapted to fit or at least conform to the profile of the enclosure region and an inner surface to conform to the profile of a post of pile that is desired to be supported. In other embodiments, the enclosure region 14 is shaped to compliment the particular post profile of a post or pile to be received.

The lower tier 10 is adapted to provide a platform on which the support device resides when in a footing hole 2. In some embodiments the lower tier 10 has a corrugated ground contacting underside. In some embodiments the underside is a corrugated profile which allows the support base 9 to easily slide over the ground when weighted down. In some embodiments, the peripheral outer edge 16 of the lower tier is raised to further improve the ability of the support device to slide over the ground. In some embodiments the lower tier 10 is rounded in profile and comprises, for example a C-shaped section.

In some embodiments the upper and/or tiers have apertures 17 in their surfaces. In some embodiments, the peripheral inner edge 15 of any lower tier aperture is raised to further improve the ability of the support device to slide over the ground. In some embodiments the side walls also have apertures 18. The apertures allow for concrete poured into a footing hole to easily flow through and around the support base 9 and the post or pile being concreted.

The support base 9 is preferably constructed from a plastic material. The plastic is ideally a rigid material such as unplasticised polystyrene or other similar materials. Recycled or biodegradable forms of plastic may also be used. A plastic support base is preferably formed from an injection or rotation moulding process.

For posts or piles up to around 1.5 m, high a builder is able to hold a post or pile level and vertical in a desired location and slide the post or pile around on the support base 9 to a desired location against a string line or other position marker. While being held, concrete is poured into the foot hole.

For posts or piles over around 1.5 m high, a builder is able to fix one or more braces to the top of the pile for improved stability. The builder may then slide the support device around in the foot hole to a desired location and align the post or pile vertically. If necessary, the bottom ends of the braces can be fixed in place by hammering pegs into the ground and fixing the braces to the pegs.

A footing hole is generally at least 250 mm square or 300 mm diameter circular. In some embodiments the lower tier of the support base 10 is around 235 mm in span.

General use of the post support device is in accordance with one or more of the following steps, in any order.

- A builder will set out a string line for a line of posts or piles, measure the particular locations for the pile or post along the line, and excavate the footing holes.
- Attaching a support device to the bottom of a post or pile with up to four fastenings. Where the support device is to support a post or pile with a square profile, a fastener is attached to each of the four sides.
- Placing the post or pile, with attached support device, into a footing hole. The support device suspends the post or pile a predetermined amount above the base of the footing hole.
- Moving or sliding the post support device around in the foot hole to locate the post or pile in a desired position. For example, the desired position is where the post or pile aligns well with the string line.
- One or more bracing members to the top of each post or pile. Where more than one brace is attached, each brace is ideally attached to the post or pile with 90 degrees between them.
- Concrete is poured into the footing hole and allowed to harden.

Use of the post support device to set piles in a typical house subfloor is in accordance with one or more of the following steps, in any order.

Ordering materials to build a house subfloor, including piles, bearers and floor joists.

Ordering support bases for each pile.

Constructing corner profiles with level profile boards about a meter outside each corner of the house.

Marking out the building perimeter with a string line. The string lines are attached to nails set into the level profile boards.

Setting out intermediate string lines to mark a line of piles.

Marking out individual piles along each string line.

Excavating the footing holes.

Attaching a support base to the bottom of each pile using a fastener. For example, the fastener is four 30 mm clouts hammered through the support base and into the pile. One each through the holes in the four fixing flaps or enclosure region on the support base.

Placing the piles with the support base attached into the footing holes.

Concreting the piles into place.

The support base 9 therefore enables setting of posts or piles in footing holes for concreting by one builder and without the requirement for support from a second builder.

This provides an improvement in the time required to set post or piles and reduces the manpower normally required to do so. Further, the support base 9 may do away with the need for some or all of the external support structure normally required for stabilising a post or pile in position before concreting.

Figure 7:
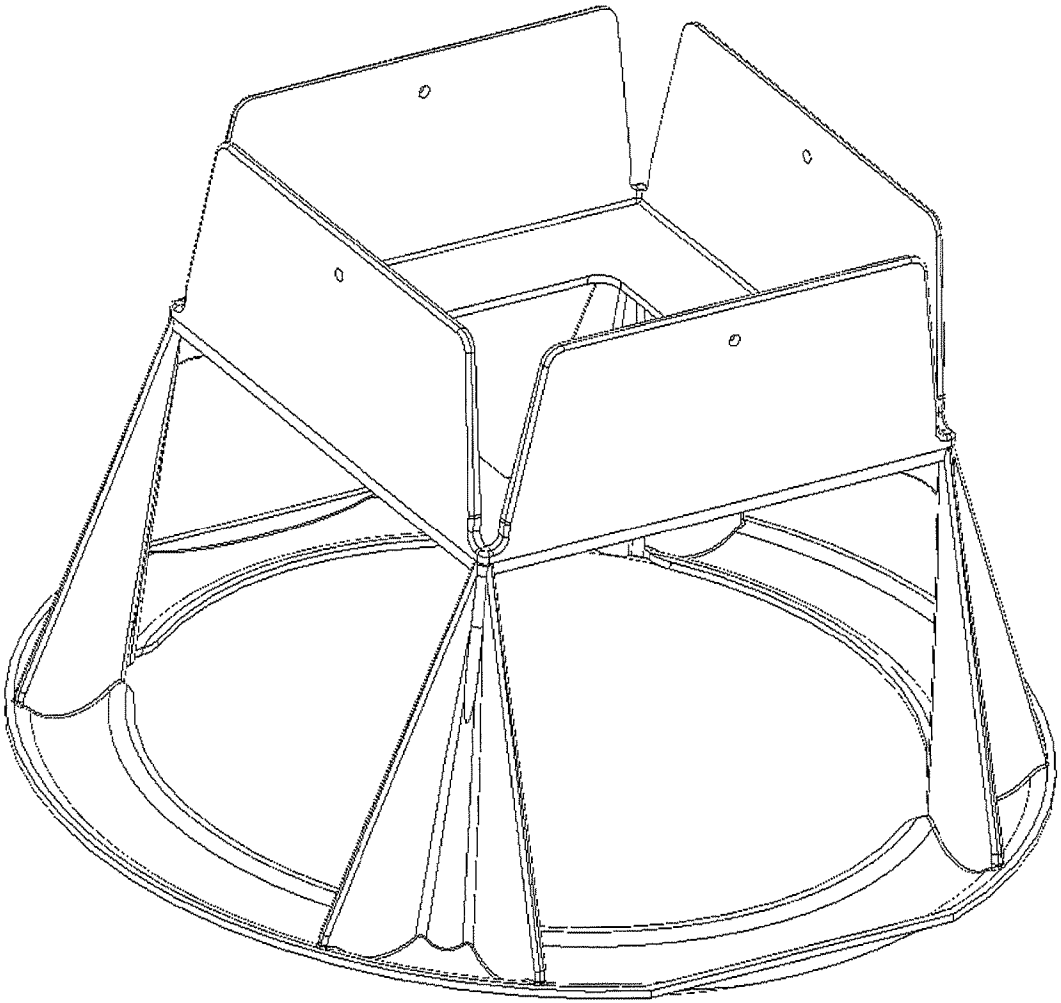
FIG. 7 shows a top perspective view of a further embodiment.
Figure 8:
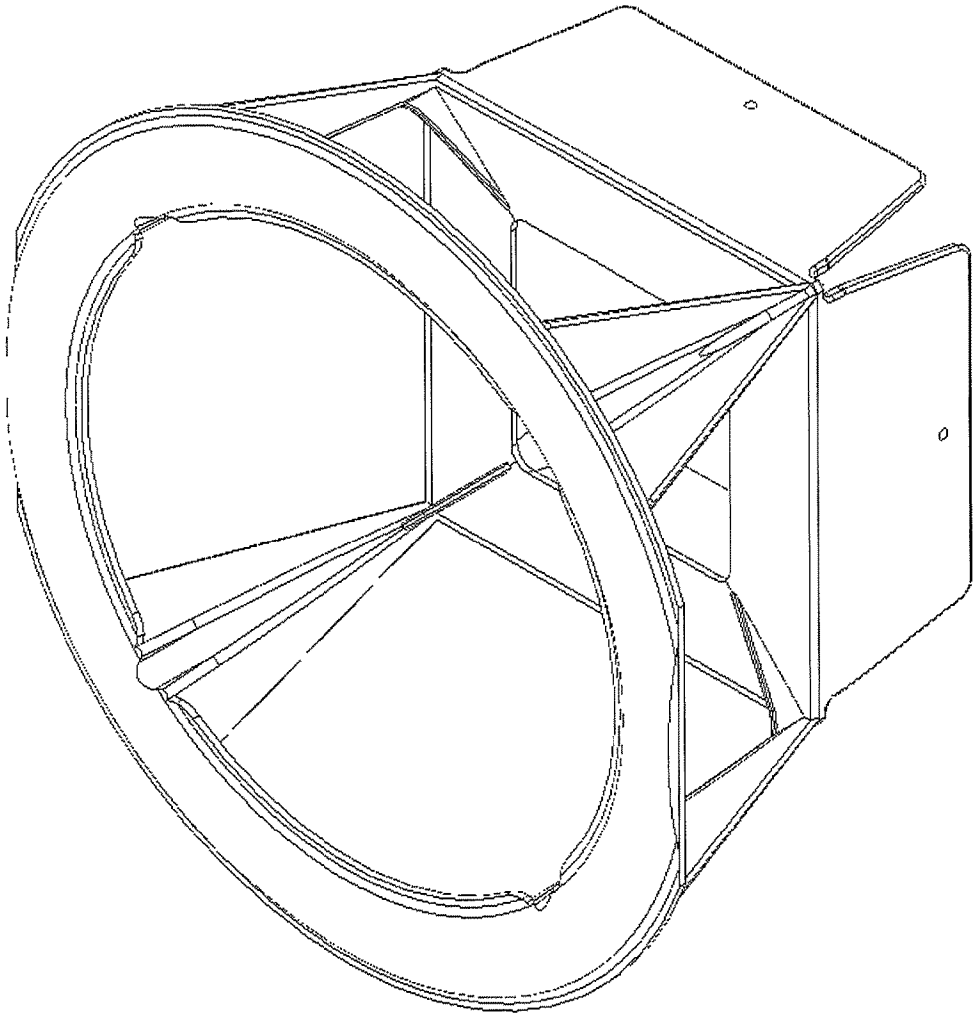
FIG. 8 shows a bottom perspective view of the embodiment of FIG. 7.
Figure 9:
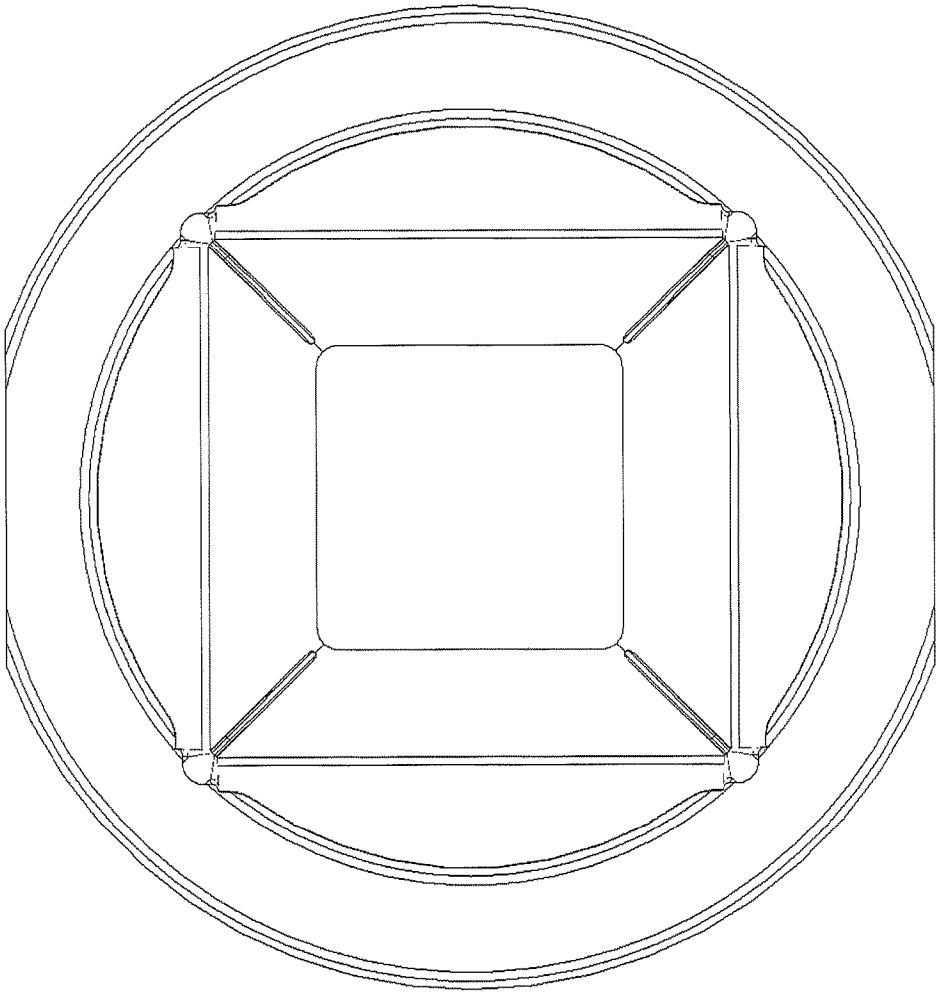
FIG. 9 shows a bottom view of the embodiment of FIG. 7.
Figure 10:
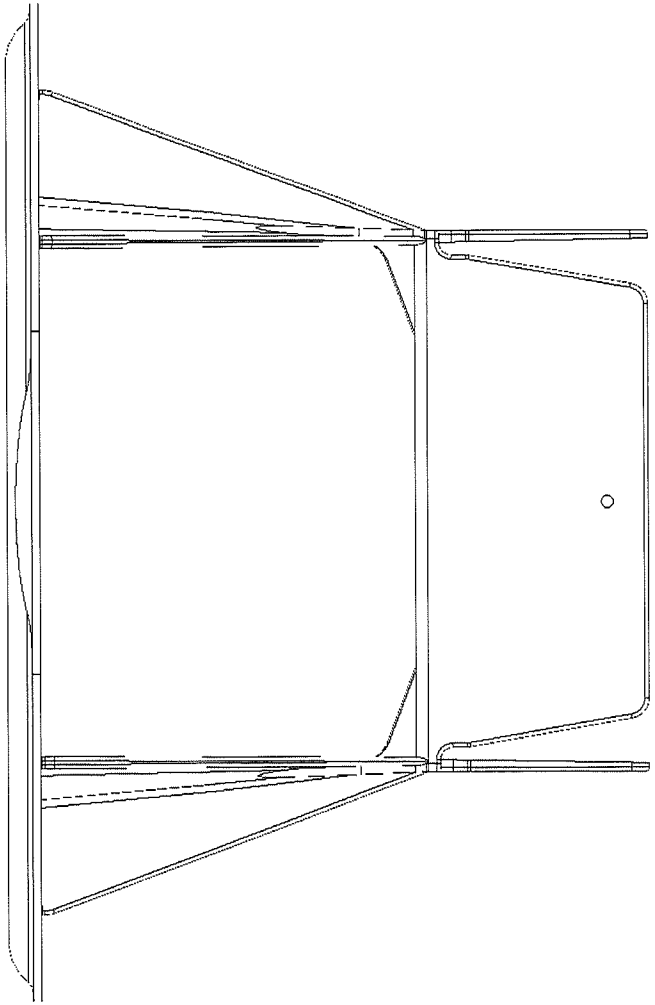
FIG. 10 shows a side view of the embodiment of FIG. 7.
Figure 11:
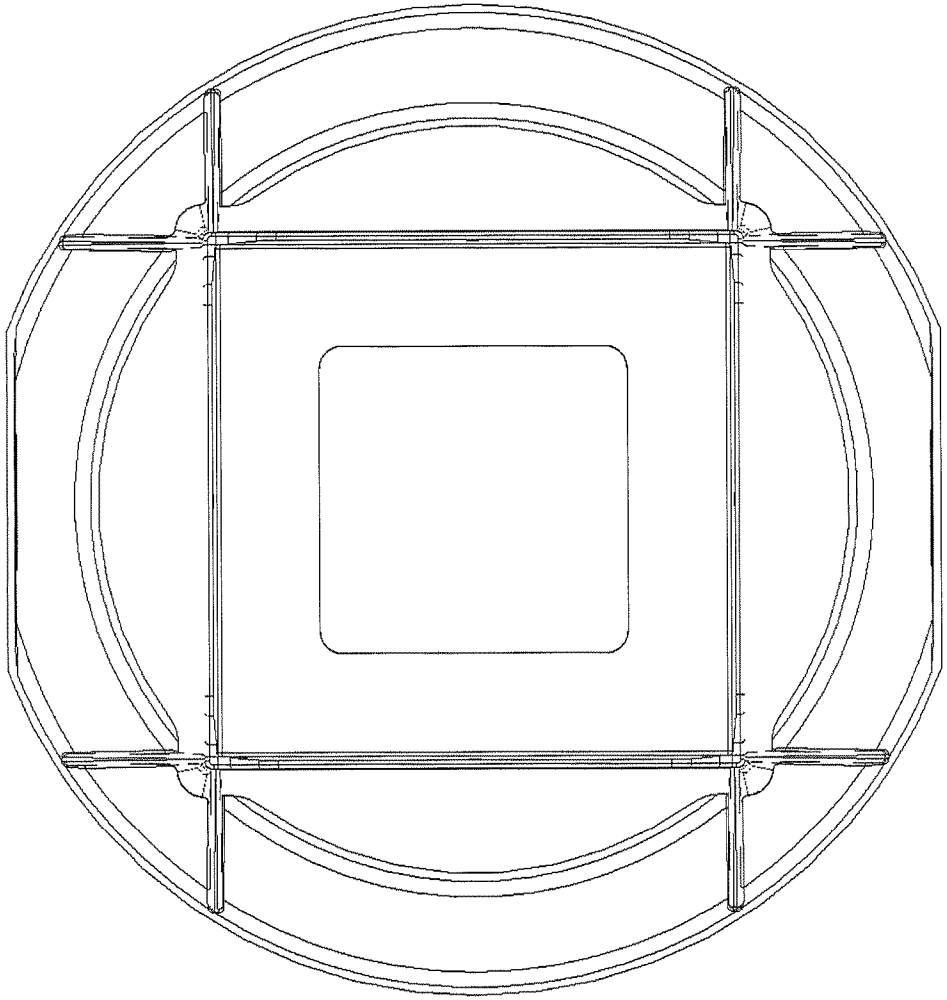
FIG. 11 shows a top view of the embodiment of FIG. 7.

FIG. 7 shows a top perspective view of a further embodiment of the invention comprising extra features that may aid in a manufacturing process such as plastic injection moulding. FIG. 8 shows a bottom perspective view of the embodiment of FIG. 7. FIG. 9 shows a bottom view of the embodiment of FIG. 7. FIG. 10 shows a side view of the embodiment of FIG. 7. FIG. 11 shows a top view of the embodiment of FIG. 7.

In particular, FIGS. 7 to 11 show the junction of the sidewalls comprising a radius or curvature. Further, the junction of the sidewalls and the upper support tier comprises one or more gussets that serve to improve the rigidity of the platform. In some embodiments the gussets span between one or more of the sidewalls and the bottom of the lower tier to provide lateral stability to the structure. In other embodiments, gussets are provided to span between the lower tier and the side walls. Those skilled in the art will appreciate the application of gussets to provide lateral support for the structure will be required in embodiments where material thickness is thin and/or where the structure is intended to support heavy posts or piles. It should also be appreciated that the openings into the region between the upper tier and lower tier should be substantially unobstructed so as to allow poured concrete to flow into that region and under the bottom of a post or pile supported by the structure.

Where in the foregoing description reference has been made to elements or integers having known equivalents, then such equivalents are included as if they were individually set forth. Although the invention has been described by way of example and with reference to particular embodiments, it is to be understood that modifications and/or improvements may be made without departing from the scope of the invention as set out in the claims.

The invention claimed is:

1. A support device adapted to support the base of a post or pile above the base of a foot hole excavated in preparation for pouring concrete, the device comprising:

a lower tier adapted to contact the base of the foot hole and provide a support surface;

an upper tier with a surface adapted to provide vertical support to the post or pile at a location above the lower tier, and the lower tier and the upper tier separated by two or more support walls that span at least between the lower tier and the upper tier to thereby define a region to be filled with concrete;

wherein the two or more support walls intersect to define a wall edge aligned substantially vertically beneath the upper tier so as to define a vertically aligned supporting structure that extends from the upper tier to the lower tier; and wherein the support device is a unitary mouldable plastic form.

2. The device as claimed in claim 1, wherein the two or more support walls extend beyond the upper tier to define, together with the upper tier, an enclosure region.

3. The device as claimed in claim 2, wherein the enclosure region is adapted to substantially enclose the bottom of a post or pile residing on the upper tier.

4. The device as claimed in claim 2, wherein the enclosure region is formed between an inner surface of the support walls and an upper surface of the upper tier.

5. The device as claimed in claim 2, wherein a portion of the two or more support walls extending beyond the upper tier has one or more holes configured to allow a fastener to pass.

6. The device as claimed in claim 1, wherein the upper tier has an internal region, defined by the two or more support walls, adapted to form an interference fit with the bottom of the post or pile to be supported.

7. The device as claimed in claim 1, wherein the upper tier has a square profile.

8. The device as claimed in claim 1, wherein the lower tier has a round or square profile.

9. The device as claimed in claim 1, wherein the lower tier has a ground contacting side that is corrugated in section.

10. The device as claimed in claim 1, wherein the lower tier has a raised outer peripheral edge.

11. The device as claimed in claim 1, wherein the lower tier has an aperture with a raised inner peripheral edge.

12. The device as claimed in claim 1, wherein the lower tier has an outside span of approximately 235 mm.

13. The device as claimed in claim 1, wherein the upper tier and lower tier are separated by a distance of approximately 100 mm.

14. The device as claimed in claim 2, wherein the device further comprises an insert comprising an outer surface adapted to fit the enclosure region and an inner surface adapted to fit the post or pile to be supported.

15. The device as claimed in claim 1, wherein the two or more support walls have one or more apertures.

16. The device as claimed in claim 1, wherein at least one of the upper tier or the lower tier has one or more apertures operable to allow poured concrete to flow into a region interior to the support walls.

17. The device as claimed in claim 1, wherein the two or more support walls overlap to form, at least in part, a lattice structure.

18. A method of using a post support device adapted to support the base of a post or pile for concreting, wherein the post support device comprises:

a lower tier and an upper tier separated by two or more support walls, the lower tier adapted to provide a ground contacting platform, the upper tier with a surface adapted to provide vertical support to the post or pile at a location above the lower tier, the two or more support walls adapted to span at least between the lower tier and the upper tier, and extend beyond the upper tier to define, together with the upper tier, an enclosure region, wherein the two or more support walls intersect to define a wall edge aligned substantially vertically beneath the upper tier so as to define a vertically aligned supporting structure that extends from the upper tier to the lower tier, and wherein the post support device is a unitary mouldable plastic form, and wherein the method comprises the following steps, in any order:

setting out a string line for a line of posts or piles; and measuring the particular locations for the piles or posts along the line;

attaching the upper tier of the post support base to the bottom of a pile or post by inserting the pile or post into the enclosure region and connecting the pile or post to the upper tier of the support base with a fastener;

then the steps of:

excavating a footing hole;

placing the post or pile, with attached post support device, into the footing hole;

moving or sliding the post support device around in the footing hole to locate the post or pile in a desired position;

attaching one or more bracing members to the top of each post or pile; and pouring concrete into the footing hole.

19. The support device as claimed in claim 1, wherein the support walls define an interior region that resides directly beneath the surface of the upper tier, above the lower tier and internal to the support walls, the interior region defining a void adapted to be filled with concrete.

20. The support device as claimed in claim 19, wherein the support walls have one or more apertures from an exterior of the support device to the interior region, the one or more apertures adapted to allow concrete poured around the exterior of the support device to flow to the interior region.

21. The support device as claimed in claim 19, the lower tier comprises an aperture extending from a lower surface to an upper surface, the aperture of a size greater than the upper tier, such that the aperture allows pass-through of an upper tier into the interior region in a stacked arrangement of multiple support devices.

* * * * *